US009646524B2

(12) United States Patent
Je et al.

(10) Patent No.: US 9,646,524 B2
(45) Date of Patent: May 9, 2017

(54) DISPLAY DEVICE FOR REDUCING SCREEN FLICKER DURING A POWER-OFF PERIOD AND METHOD FOR DRIVING THE SAME

(71) Applicant: LG DISPLAY CO., LTD., Seoul (KR)

(72) Inventors: Sungmin Je, Daegu (KR); Jungyoul Kang, Jung-ri (KR); Kyoungkoo Lee, Gumi-si (KR); Hansu Kim, Daegu (KR); Jinhee Lee, Nam-gu (KR); Youngmin Seo, Daegu (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/071,753

(22) Filed: Nov. 5, 2013

(65) Prior Publication Data

US 2014/0125564 A1 May 8, 2014

(30) Foreign Application Priority Data

Nov. 6, 2012 (KR) ..... 10-2012-0124875

(51) Int. Cl.
*G09G 3/36* (2006.01)
*G09G 3/20* (2006.01)

(52) U.S. Cl.
CPC ..... *G09G 3/20* (2013.01); *G09G 2330/027* (2013.01)

(58) Field of Classification Search
CPC ..... G09G 3/3685; G09G 3/36; G09G 5/00; G11C 19/00; G06F 3/038
USPC ..... 345/100
See application file for complete search history.

(56) References Cited

U.S. PATENT DOCUMENTS

| | | | | |
|---|---|---|---|---|
| 5,248,963 | A | 9/1993 | Yasui et al. | |
| 5,883,609 | A * | 3/1999 | Asada | G09G 3/3648 345/100 |
| 6,937,216 | B1 * | 8/2005 | Ishiyama | 345/87 |
| 2005/0179630 | A1 * | 8/2005 | Huang | 345/87 |
| 2005/0275613 | A1 | 12/2005 | Woo et al. | |
| 2008/0129903 | A1 * | 6/2008 | Hong et al. | 349/36 |
| 2008/0266216 | A1 * | 10/2008 | Choi | 345/77 |
| 2009/0115716 | A1 * | 5/2009 | Murakami et al. | 345/100 |
| 2010/0134401 | A1 * | 6/2010 | Shin | G09G 3/3611 345/99 |
| 2010/0323431 | A1 * | 12/2010 | Rutkowski et al. | 435/286.1 |
| 2011/0157250 | A1 * | 6/2011 | Hasegawa | 345/690 |
| 2014/0092144 | A1 * | 4/2014 | Kim et al. | 345/690 |

OTHER PUBLICATIONS

Office Action issued in corresponding United Kingdom Patent Application No. GB1310992.1, mailed Dec. 12, 2013, 7 pages.

* cited by examiner

*Primary Examiner* — Pegeman Karimi
(74) *Attorney, Agent, or Firm* — Brinks Gilson & Lione

(57) ABSTRACT

A display device includes a display panel, a data driver supplying a data signal to the display panel, a gate driver supplying a gate signal to the display panel, a power supply unit supplying electric power to at least one of the display panel, the data driver, and the gate driver, a voltage monitor unit which monitors an output voltage output from the power supply unit and outputs an alarm signal when the output voltage is cut off, and a timing controller which outputs a gate control signal converting all of gate signal output from the gate driver into a gate-on voltage and a data control signal converting all of the data signal output from the data driver into a black data signal in response to the alarm signal.

20 Claims, 6 Drawing Sheets

DISPLAY DEVICE FOR REDUCING SCREEN FLICKER DURING A POWER-OFF PERIOD AND METHOD FOR DRIVING THE SAME

This application claims the benefit of priority of Korean Patent Application No. 10-2012-0124875 filed on Nov. 6, 2012, the entire contents of which is incorporated herein by reference for all purposes as if fully set forth herein.

FIELD OF THE INVENTION

Embodiments of the invention relate to a display device and a method for driving the same.

DESCRIPTION OF THE RELATED ART

With the development of information technology, the market for display devices as connection media between users and information is growing. Display devices such as liquid crystal display (LCD) devices and organic light emitting display (OLED) devices have been manufactured to have various sizes including small, middle, and large sizes.

The display device includes a display panel including subpixels arranged in a matrix form, a driver for driving the display panel, and a timing controller for controlling the driver. The driver includes a gate driver supplying a gate signal to the display panel and a data driver supplying a data signal to the display panel.

When the related art display device is turned off, even if the data signal output from the data driver is supplied at the same time as the gate signal corresponding to a gate high voltage, a screen flicker or image sticking is partially generated in the display panel because of supplying of the data signal immediately before the turn-off of the display device.

For example, when an image with a gradation from black to white is displayed on the display panel and then the display device is turned off, an area ranging from an upper portion to a middle portion of the display panel may show black or a color similar to black. The reason is because a final data signal output from the data driver when the display device is turned off represents black or a color similar to black. On the other hand, when the image with the gradation from black to white is displayed on the display panel and then the display device is turned off, an area ranging from the middle portion to a lower portion of the display panel may show white or a color similar to white. The reason is because a final data signal output from the data driver when the display device is turned off represents white or a color similar to white.

When the display device is repeatedly turned on and off, the screen flicker or the image sticking is not generated in the area ranging from the upper portion to the middle portion of the display panel, but is generated in the area ranging from the middle portion to the lower portion of the display panel.

SUMMARY OF THE INVENTION

In one aspect, there is a display device including a display panel, a data driver configured to supply a data signal to the display panel, a gate driver configured to supply a gate signal to the display panel, a power supply unit configured to supply electric power to at least one of the display panel, the data driver, and the gate driver, a voltage monitor unit configured to monitor an output voltage output from the power supply unit and output an alarm signal when the output voltage is cut off, and a timing controller configured to output a gate control signal converting all of gate signal output from the gate driver into a gate-on voltage and a data control signal converting all of the data signal output from the data driver into a black data signal in response to the alarm signal.

In another aspect, there is a display device including a display panel, a data driver configured to supply a data signal to the display panel, a gate driver configured to supply a gate signal to the display panel, a power supply unit configured to supply electric power to at least one of the display panel, the data driver, and the gate driver, and a timing controller configured to control the data driver and the gate driver, wherein the data driver outputs a gate control signal, which monitors an input voltage and converts all of gate signal output from the gate driver into a gate-on voltage when the input voltage is out of a predetermined range, and also converts all of data signal output from the data driver into a black data signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Example embodiments of the invention will be described with reference to FIGS. 1 to 10.

First Embodiment

Figure 1:
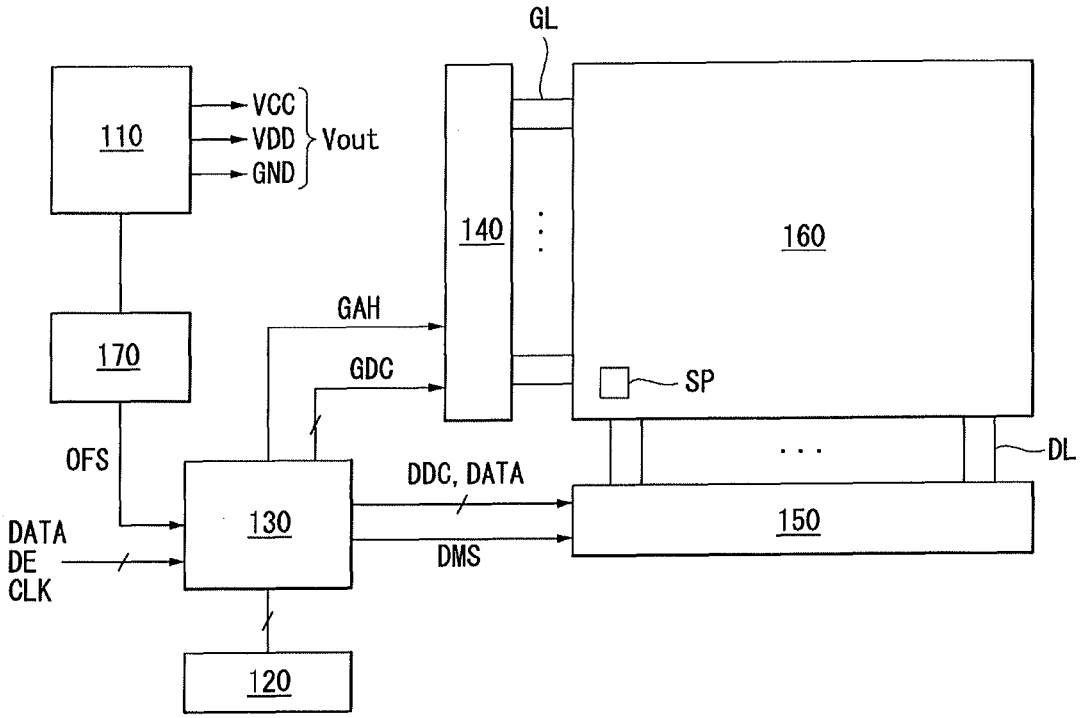
FIG. 1 is a block diagram schematically showing a display device according to a first embodiment of the invention.
Figure 2:
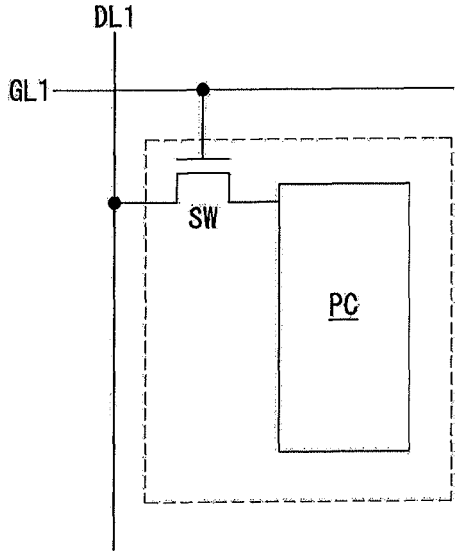
FIG. 2 schematically illustrates a configuration of a subpixel shown in FIG. 1.

FIG. 1 is a block diagram schematically showing a display device according to a first embodiment of the invention. FIG. 2 schematically illustrates a configuration of a subpixel shown in FIG. 1.

The display device according to the first embodiment of the invention includes a power supply unit 110, a timing controller 130, a control memory 120, a gate driver 140, a data driver 150, a display panel 160, and a voltage monitor unit 170.

The power supply unit 110 may convert power supplied from an outside source (e.g., a power outlet) to generate an output voltage. The output voltage can include a first potential voltage VCC, a second potential voltage VDD, a ground level voltage GND, etc. The power supply unit 110 outputs the output voltage. The first potential voltage VCC, the second potential voltage VDD, and the ground level voltage GND output from the power supply unit 110 are supplied to the timing controller 130, the control memory 120, the gate driver 140, the data driver 150, the display panel 160, and the voltage monitor unit 170.

The voltage monitor unit 170 monitors the output voltage and outputs an alarm signal OFS when the output voltage is cut off. For example, the voltage monitor unit 170 may determine when one or more of the voltages included in the output voltage changes in value (e.g., transitions from a high to low value) or when the output voltage is no longer received. The voltage monitor unit 170 may be configured separately from the power supply unit 110 and/or embedded in the power supply unit 110.

The control memory 120 supplies data stored therein to the timing controller 130. The control memory 120 stores extended display identification data (EDID) including a resolution, a frequency, timing information, etc. of the display panel 160 or compensation data. The control memory 120 is internal or external memory of the timing controller 130.

The timing controller 130 gathers the extended display identification data (EDID) including the resolution, the frequency, the timing information, etc. of the display panel 160 or the compensation data from the control memory 120 through an $I^2C$ interface, etc. The timing controller 130 generates a gate timing control signal GDC for controlling operation timing of the gate driver 140 and a data timing control signal DDC for controlling operation timing of the data driver 150. The timing controller 130 supplies the data timing control signal DDC and a data signal DATA to the data driver 150.

In response to the alarm signal OFS output from the voltage monitor unit 170, the timing controller 130 may output a gate control signal GAH converting all of gate signal output from the gate driver 140 into a gate-on voltage and a data control signal DMS converting all of the data signal output from the data driver 150 into a black data signal.

The data driver 150 samples and latches the data signal DATA in response to the data timing control signal DDC supplied from the timing controller 130. The data driver 150 converts the latched data signal DATA into a gamma reference voltage and outputs the gamma reference voltage. The data driver 150 supplies the data signal DATA to subpixels SP of the display panel 160 through data lines DL. The data driver 150 converts all of the data signal output from the data driver 150 into the black data signal in response to the data control signal DMS supplied from the timing controller 130.

The gate driver 140 outputs the gate signal while shifting a level of the gate voltage in response to the gate timing control signal GDC supplied from the timing controller 130. The gate driver 140 supplies the gate signal to the subpixels SP of the display panel 160 through gate lines GL. The gate driver 140 may convert all of the gate signal output from the gate driver 140 into the gate-on voltage in response to the gate control signal GAH supplied from the timing controller 130. In the embodiment of the invention, the gate-on voltage is a voltage capable of turning on a gate electrode of a switching transistor included in each of the subpixels SP. In the following description, the switching transistor included in each of the subpixels SP uses an N-type transistor as an example. Further, the gate-on voltage is referred to as a gate high voltage.

The display panel 160 displays an image in response to the gate signal supplied from the gate driver 140 and the data signal DATA supplied from the data driver 150. The display panel 160 includes the subpixels SP which controls light so as to display the image.

As shown in FIG. 2, each of the subpixels SP includes a switching transistor SW connected to a gate line GL1 and a data line DL1 and a pixel circuit PC driven in response to the data signal DATA supplied through the switching transistor SW. The display panel 160 including the subpixels SP is configured as a liquid crystal display panel including a liquid crystal element or an organic light emitting display panel including an organic light emitting element based on configuration of the pixel circuits PC of the subpixels SP.

When the display panel 160 is configured as the liquid crystal display panel, the display panel 160 may be implemented in a twisted nematic (TN) mode, a vertical alignment (VA) mode, an in-plane switching (IPS) mode, a fringe field switching (FFS) mode, or an electrically controlled birefringence (ECB) mode. When the display panel 160 is configured as the organic light emitting display panel, the display panel 160 may be implemented in a top emission type, a bottom emission type, or a dual emission type.

The display device according to the first embodiment of the invention may solve a screen flicker or image sticking appearing in a portion of the display panel 160 even if the power supply unit 110 is repeatedly turned on and off. This is described in detail below.

Figure 3:
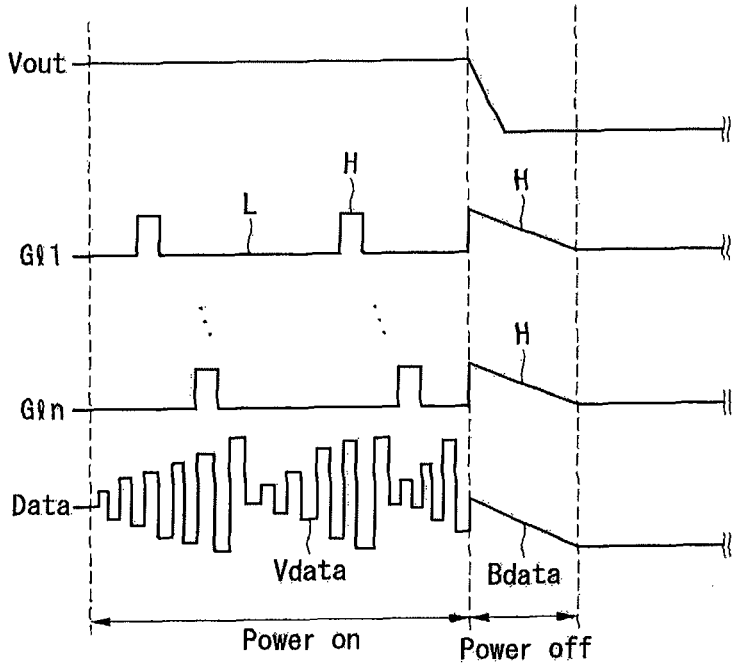
FIG. 3 is an exemplary waveform diagram of a gate signal and a data signal supplied when a power supply unit is turned off.
Figure 4:
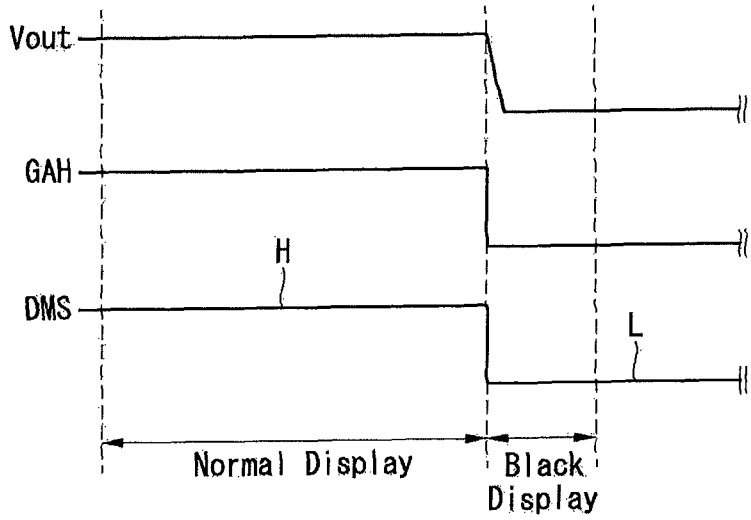
FIG. 4 is an exemplary waveform diagram of a gate control signal and a data signal output from a timing controller when a power supply unit is turned off.

FIG. 3 is an exemplary waveform diagram of the gate signal and the data signal supplied when the power supply unit is turned off. FIG. 4 is an exemplary waveform diagram of the gate control signal and the data signal output from the timing controller when the power supply unit is turned off.

As shown in FIGS. 3 and 4, the display device according to the first embodiment of the invention is driven as follows during a first period Power-on (or Normal Display) in which the power supply unit 110 is normally held at an output voltage Vout.

During the Normal Display period, the power supply unit 110 outputs the output voltage Vout. The voltage monitor unit 170 monitors the output voltage Vout output from the power supply unit 110. When the power supply unit 110 outputs the output voltage Vout, the voltage monitor unit 170 does not output the alarm signal. The timing controller 130 causes the gate driver 140 to sequentially output the gate signal corresponding to the gate high voltage 'H' through the gate lines GL. For example, the timing controller 130 may cause the gate driver 140 to periodically output the gate high voltage for a particular gate line. The timing controller 130 may also send sequential or cascaded gate high voltages from gate line 1 to gate line 'n'. Further, the timing controller 130 causes the data driver 150 to normally output the data signal through the data lines DL. Hence, the selected subpixels SP of the display panel 160 are normally driven.

As shown in FIGS. 3 and 4, the display device according to the first embodiment of the invention is driven as follows during a second period Power-off (or Black Display) in which the power supply unit 110 is not held at the output voltage Vout by a user.

In transition to a Black Display period, the voltage monitor unit 170 monitors the output voltage Vout output from the power supply unit 110. When the power supply unit 110 does not output the output voltage Vout, ceases to output the output voltage Vout, or when the voltage monitor unit 170 determines a change in the monitored output voltage Vout, the voltage monitor unit 170 outputs the alarm signal OFS. The timing controller 130 outputs the gate control signal GAH and the data control signal DMS in response to the alarm signal OFS. In response of receiving the alarm signal OFS, the gate driver 140 may convert all of the gate signals (e.g., for each gate line in the display device) into the gate high voltage 'H'. As one example, the gate driver 140 may simultaneously convert multiple or all of the gate signals into the gate high voltage. The gate driver 140 may convert the gate signal for a particular gate line regardless of a gate cycle timing of the particle gate line. That is, the gate driver 140 may send a scan pulse to a gate signal at a predetermined rate or periodicity, e.g., according to a sequential scan pulse timing for sending the scan pulse to each of the gate lines in a display device. However, in response to receiving the alarm signal OFS, the gate driver 140 may break the periodic sending of the scan pulse to the particular gate line and send a gate high voltage to the particular gate line outside of the predetermined rate or periodicity. Hence, the gate signal corresponding to a gate low voltage 'L' is converted into the gate high voltage 'H'. The data driver 150 converts all of the data signal Vdata into a black data signal Bdata in response to the data control signal DMS.

When an image with a gradation from black to white is displayed on the display panel 160 and then the power supply unit 110 is turned off, a final data signal output from the data driver 150 is the black data signal Bdata. Therefore, all of the subpixels SP of the display panel 160 show the black and are turned off. Thus, the display device according to the first embodiment of the invention may solve the screen flicker or the image sticking appearing in a portion of the display panel 160 even if the power supply unit 110 is repeatedly turned on and off.

When the display panel 160 is configured as the liquid crystal display panel including the liquid crystal element, the black data signal Bdata has a gray level (or voltage level) forming an equipotential along with a common voltage Vcom supplied through a common voltage line. On the other hand, when the display panel 160 is configured as the organic light emitting display panel including the organic light emitting element, the black data signal Bdata has a gray level (or voltage level) forming an equipotential along with a ground level voltage supplied through a ground line.

The display device according to the first embodiment of the invention may be partially driven as follows so as to operate as described above.

Figure 5:
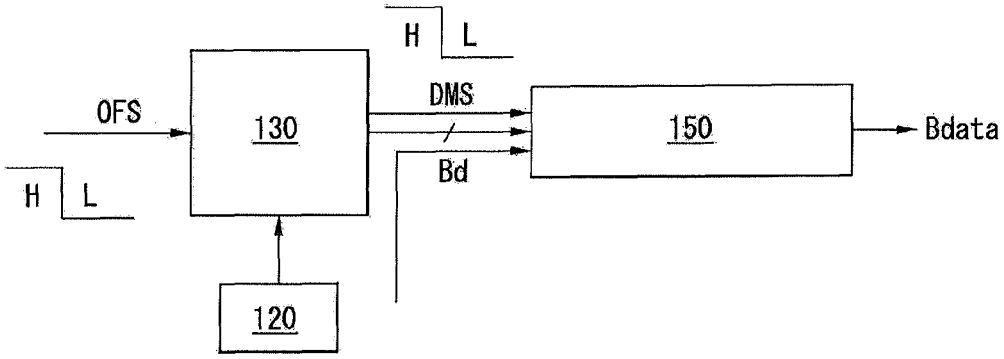
FIG. 5 illustrates a first exemplary configuration for outputting a black data signal.
Figure 6:
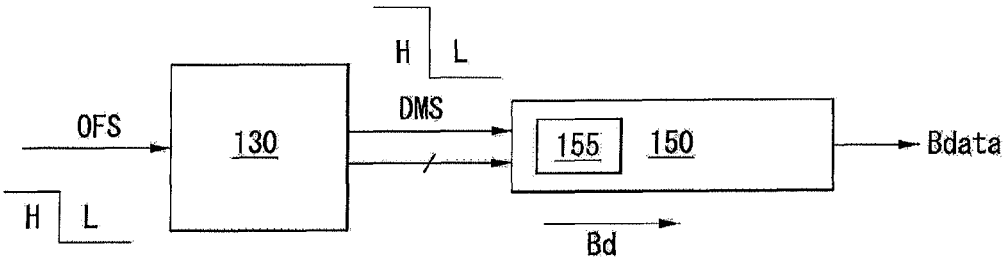
FIG. 6 illustrates a second exemplary configuration for outputting a black data signal.
Figure 7:
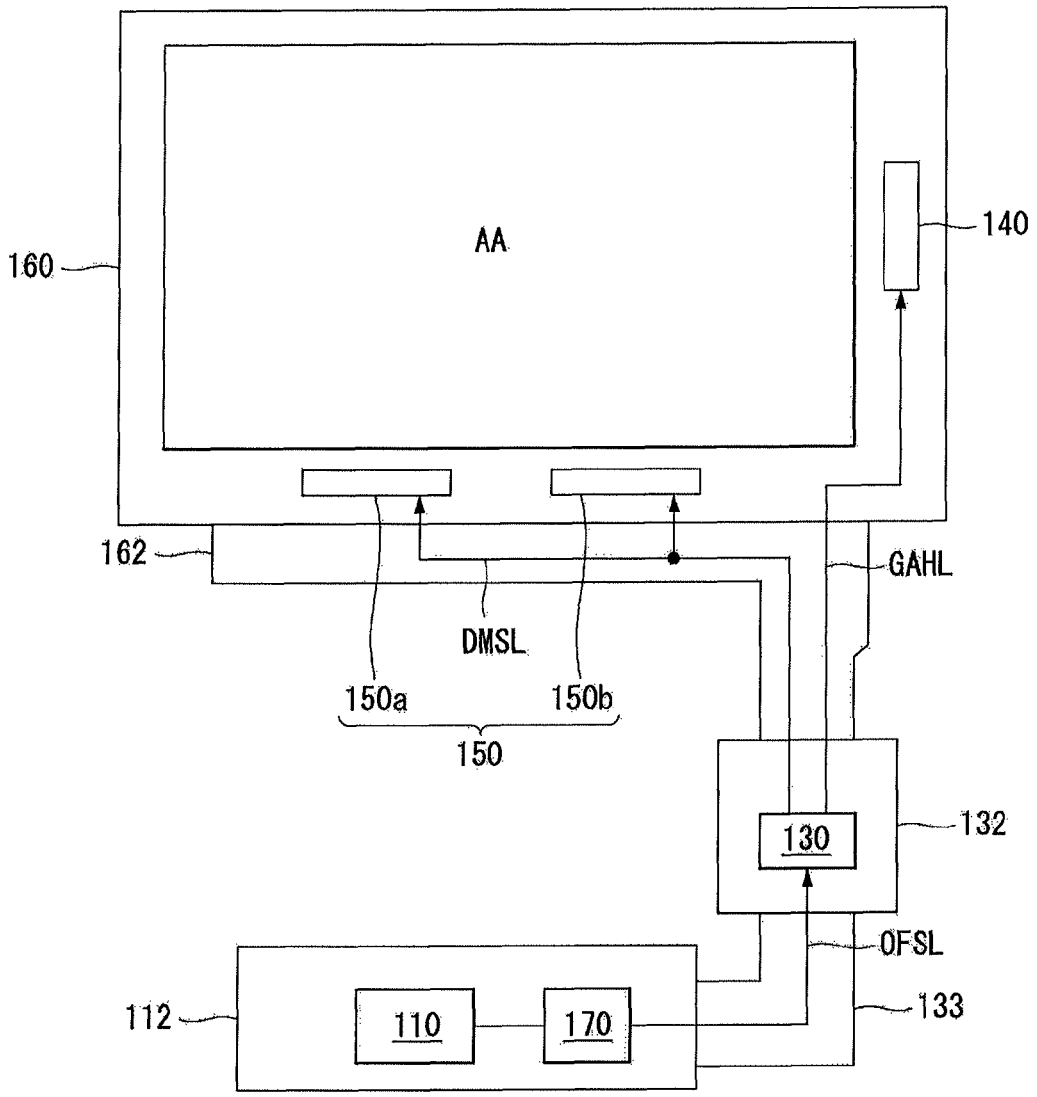
FIG. 7 schematically illustrates an exemplary disposition of components shown in FIG. 1.

FIG. 5 illustrates a first exemplary configuration for outputting a black data signal. FIG. 6 illustrates a second exemplary configuration for outputting a black data signal. FIG. 7 schematically illustrates an exemplary disposition of components shown in FIG. 1.

First Exemplary Configuration

The timing controller 130 may determine that the output voltage of the power supply unit 110 is cut off when the alarm signal OFS is changed from a high logic level 'H' to a low logic level 'L'. The timing controller 130 reads black data Bd from the control memory 120. The timing controller 130 supplies the black data Bd and the data control signal DMS to the data driver 150. In this instance, the timing controller 130 converts a state of the data control signal DMS from the high logic level 'H' to the low logic level 'L'. Hence, when the power supply unit 110 is turned off, the data driver 150 converts all of the data signal into the black data signal Bdata and outputs the black data signal Bdata.

[Second Exemplary Configuration]

The timing controller 130 may determine that the output voltage of the power supply unit 110 is cut off when the alarm signal OFS is changed from a high logic level 'H' to a low logic level 'L'. The timing controller 130 supplies the data control signal DMS to the data driver 150. In this instance, the timing controller 130 converts a state of the data control signal DMS from the high logic level 'H' to the low logic level 'L'. When the state of the data control signal DMS is converted to the low logic level 'L', the data driver 150 reads black data Bd from a data memory 155 of the data driver 150. Hence, when the power supply unit 110 is turned off, the data driver 150 converts all of the data signal into the black data signal Bdata and outputs the black data signal Bdata.

The display device according to the first embodiment of the invention may be disposed as follows.

The power supply unit 110 and the voltage monitor unit 170 are disposed on a system board 112. The power supply unit 110 and the voltage monitor unit 170 may be mounted on the system board 112 in the form of an integrated circuit (IC).

The timing controller 130 is disposed on a control board 132. The timing controller 130 may be mounted on the control board 132 in the form of a field programmable gate array (FPGA). The timing controller 130 and the data driver 150 may be integrated into one part depending on the size of the display panel 160.

The gate driver 140 is disposed on the side of a non-display area except a display area AA of the display panel 160 in a vertical direction. The gate driver 140 may be formed on the display panel 160 in a gate-in panel (GIP) manner or may be mounted on an external substrate in the form of an integrated circuit (IC).

The data driver 150 is disposed on the bottom of the non-display area of the display panel 160 in a horizontal direction. The data driver 150 may be mounted on the display panel 160 in the form of an integrated circuit (IC) or may be mounted on the external substrate.

The system board 112 and the control board 132 may be electrically connected to each other through a first flexible substrate 133. The voltage monitor unit 170 and the timing controller 130 may be connected to each other through an alarm signal line OFSL. The alarm signal line OFSL transmits the alarm signal OFS.

The control board 132 and the display panel 160 may be electrically connected to each other through a second flexible substrate 162. The timing controller 130 and the data driver 150 may be connected to each other through a data control signal line DMSL. The data control signal line DMSL transmits the data control signal DMS. The timing controller 130 and the gate driver 140 may be connected to each other through a gate control signal line GAHL. The gate control signal line GAHL transmits the gate control signal GAH.

The data driver 150 includes a data control signal input terminal receiving the data control signal DMS, and the gate driver 140 includes a gate control signal input terminal receiving the gate control signal GAH. When a control signal of a low logic level is supplied to each of the data control signal input terminal and the gate control signal input terminal, the data driver 150 converts all of the data signal into the black data signal, and the gate driver 140 converts all of the gate signal into the gate high voltage. In other words, because the data control signal DMS and the gate control signal GAH use the same logic level, the data control signal line DMSL and the gate control signal line GAHL may be integrated into one line.

Second Embodiment

Figure 8:
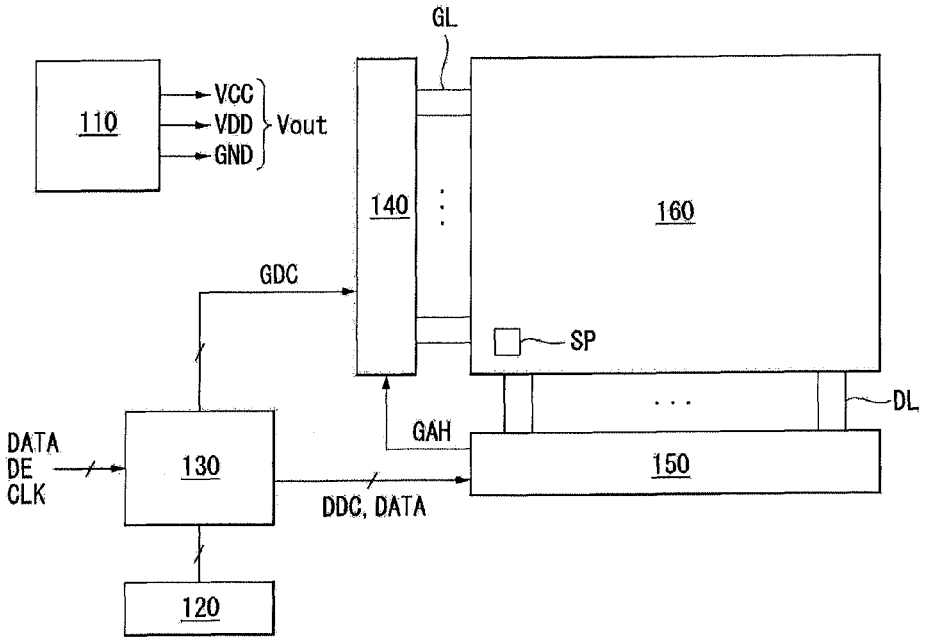
FIG. 8 is a block diagram schematically showing a display device according to a second embodiment of the invention.

FIG. 8 is a block diagram schematically showing a display device according to a second embodiment of the invention.

The display device according to the second embodiment of the invention includes a power supply unit 110, a timing controller 130, a control memory 120, a gate driver 140, a data driver 150, and a display panel 160.

The power supply unit 110 converts the power supplied from the outside and generates an output voltage including a first potential voltage VCC, a second potential voltage VDD, a ground level voltage GND, etc. The power supply unit 110 outputs the output voltage. The power supply unit 110 outputs the output voltage. The first potential voltage VCC, the second potential voltage VDD, and the ground level voltage GND output from the power supply unit 110 are supplied to the timing controller 130, the control memory 120, the gate driver 140, the data driver 150, and the display panel 160.

The control memory 120 supplies data stored therein to the timing controller 130. The control memory 120 stores extended display identification data (EDID) including a resolution, a frequency, timing information, etc. of the display panel 160 or compensation data. The control memory 120 is internal or external memory of the timing controller 130.

The timing controller 130 gathers the extended display identification data (EDID) including the resolution, the frequency, the timing information, etc. of the display panel 160 or the compensation data from the control memory 120 through an $I^2C$ interface, etc. The timing controller 130 generates a gate timing control signal GDC for controlling operation timing of the gate driver 140 and a data timing control signal DDC for controlling operation timing of the data driver 150. The timing controller 130 supplies the data timing control signal DDC and a data signal DATA to the data driver 150.

The data driver 150 samples and latches the data signal DATA in response to the data timing control signal DDC supplied from the timing controller 130. The data driver 150 converts the latched data signal DATA into a gamma reference voltage and outputs the gamma reference voltage. The data driver 150 supplies the data signal DATA to subpixels SP of the display panel 160 through data lines DL.

The data driver 150 outputs a gate control signal GAH, which monitors an input voltage and converts all of gate signal output from the gate driver 140 into a gate high voltage when the input voltage is out of a predetermined range, and also converts all of the data signal output from the data driver 150 into a black data signal.

The gate driver 140 outputs the gate signal while shifting a level of the gate voltage in response to the gate timing control signal GDC supplied from the timing controller 130. The gate driver 140 supplies the gate signal to the subpixels SP of the display panel 160 through gate lines GL. The gate driver 140 converts all of the gate signal output from the gate driver 140 into the gate high voltage in response to the gate control signal GAH supplied from the data driver 150.

The display panel 160 displays an image in response to the gate signal supplied from the gate driver 140 and the data signal DATA supplied from the data driver 150. The display panel 160 includes the subpixels SP which controls light so as to display the image.

Each of the subpixels SP includes a switching transistor SW connected to a gate line GL1 and a data line DL1 and a pixel circuit PC driven in response to the data signal DATA supplied through the switching transistor SW. The display panel 160 including the subpixels SP is configured as a liquid crystal display panel including a liquid crystal element or an organic light emitting display panel including an organic light emitting element based on configuration of the pixel circuits PC of the subpixels SP.

When the display panel 160 is configured as the liquid crystal display panel, the display panel 160 may be implemented in a twisted nematic (TN) mode, a vertical alignment (VA) mode, an in-plane switching (IPS) mode, a fringe field switching (FFS) mode, or an electrically controlled birefringence (ECB) mode. When the display panel 160 is configured as the organic light emitting display panel, the display panel 160 may be implemented in a top emission type, a bottom emission type, or a dual emission type.

The display device according to the second embodiment of the invention may solve a screen flicker or image sticking appearing in a portion of the display panel 160 even if the power supply unit 110 is repeatedly turned on and off. This is described in detail below.

Figure 9:
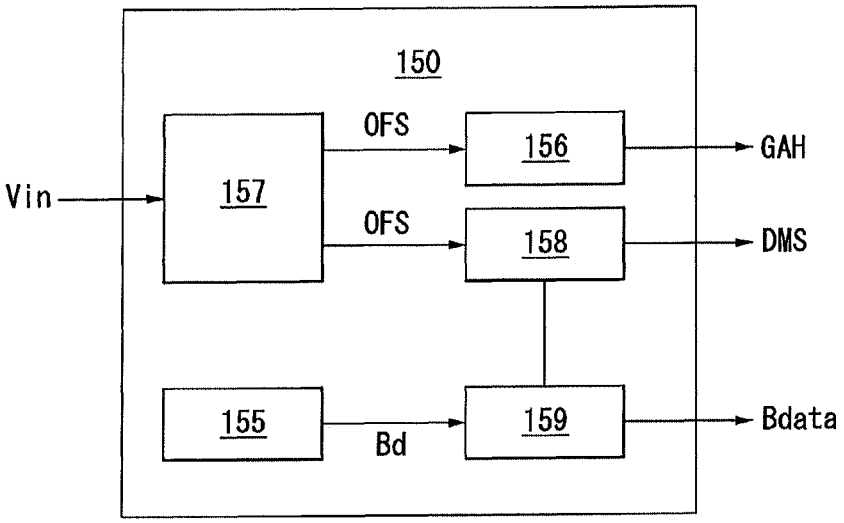
FIG. 9 illustrates a configuration of a data driver.
Figure 10:
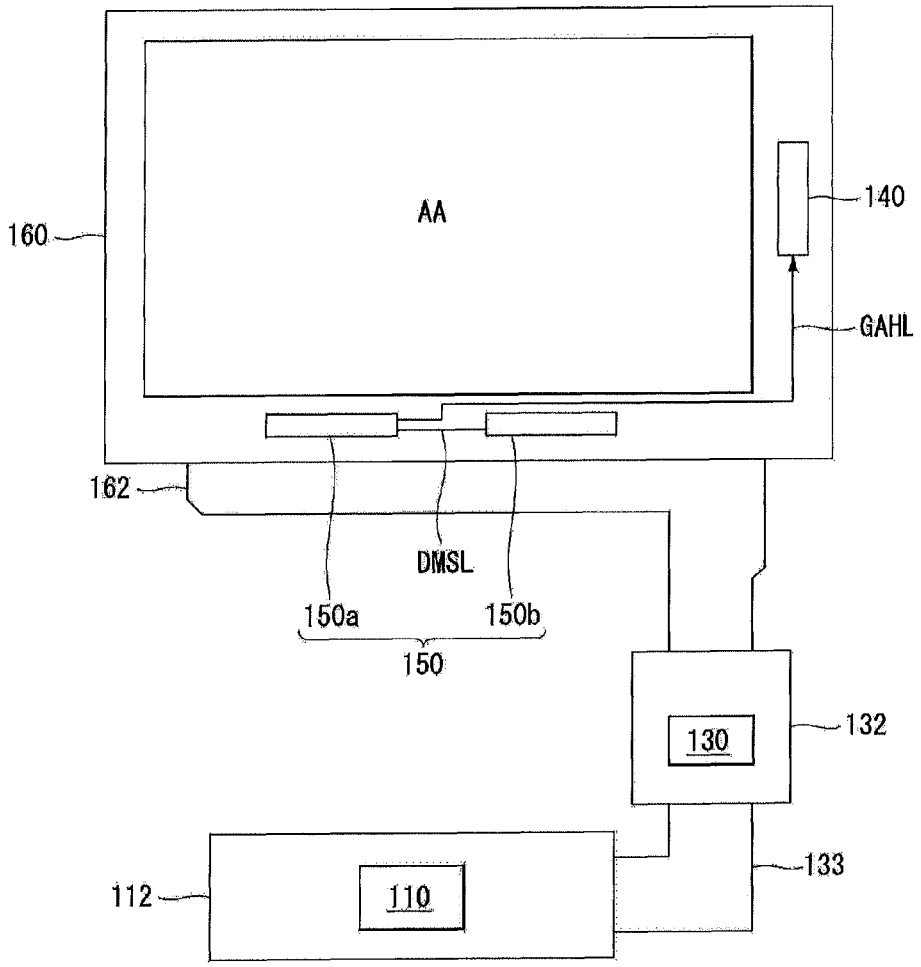
FIG. 10 schematically illustrates an exemplary disposition of components shown in FIG. 8.

FIG. 9 illustrates a configuration of the data driver. FIG. 10 schematically illustrates an exemplary disposition of components shown in FIG. 8.

The data driver 150 includes a voltage monitor unit 157, a gate control signal output unit 156, a data control signal output unit 158, a data memory 155, and a data output unit 159. The data memory 155 is internal or external memory of the data driver 150.

The voltage monitor unit 157 includes a Schmitt trigger circuit capable of setting a minimum allowable value of an input voltage Vin, etc. When the input voltage Vin is less than the minimum allowable value, the voltage monitor unit 157 outputs an alarm signal OFS. Thus, the voltage monitor unit 157 monitors the input voltage Vin input to the data driver 150. Hence, when the input voltage Vin is out of a predetermined range, the voltage monitor unit 157 supplies the alarm signal OFS to the gate control signal output unit 156 and the data control signal output unit 158.

When the gate control signal output unit 156 receives the alarm signal OFS from the voltage monitor unit 157, the gate control signal output unit 156 outputs the gate control signal GAH converting all of the gate signal output from the gate driver 140 into the gate high voltage. Hence, when the power supply unit 110 is turned off, the gate driver 140 converts all of the gate signal into the gate high voltage and outputs the gate high voltage.

When the data control signal output unit 158 receives the alarm signal OFS from the voltage monitor unit 157, the data control signal output unit 158 converts all of the data signal output from the data driver 150 into the black data signal. When the alarm signal OFS is supplied, the data control signal output unit 158 controls the data output unit 159.

The data output unit 159 reads black data Bd stored in the data memory 155 of the data driver 150 under the control of the data control signal output unit 158 and then converts all of the data signal into the black data signal Bdata. The data output unit 159 then outputs the black data signal Bdata. Hence, when the power supply unit 110 is turned off, the data driver 150 converts all of the data signal into the black data signal Bdata and outputs the black data signal Bdata.

The voltage monitor unit 157 may be configured separately from the data driver 150. In this instance, the data driver 150 outputs the gate control signal GAH in response to the alarm signal OFS supplied from the voltage monitor unit 157, and also converts all of the data signal into the black data signal Bdata to output the black data signal Bdata.

The display device according to the second embodiment of the invention may be disposed as follows.

The power supply unit 110 is disposed on a system board 112. The power supply unit 110 may be mounted on the system board 112 in the form of an integrated circuit (IC). The timing controller 130 is disposed on a control board 132. The timing controller 130 may be mounted on the control board 132 in the form of a field programmable gate array (FPGA). The timing controller 130 and the data driver 150 may be integrated into one part depending on the size of the display panel 160.

The gate driver 140 is disposed on the side of a non-display area except a display area AA of the display panel 160 in a vertical direction. The gate driver 140 may be formed on the display panel 160 in a gate-in panel (GIP) manner or may be mounted on an external substrate in the form of an integrated circuit (IC).

The data driver 150 is disposed on the bottom of the non-display area of the display panel 160 in a horizontal direction. The data driver 150 may be mounted on the display panel 160 in the form of an integrated circuit (IC) or may be mounted on the external substrate.

The system board 112 and the control board 132 may be electrically connected to each other through a first flexible substrate 133. The control board 132 and the display panel 160 may be electrically connected to each other through a second flexible substrate 162.

The data driver 150 may include N data drivers depending on the size of the display panel 160, where N is a positive integer equal to or greater than 2. The embodiment of the invention describes that the data driver 150 includes a master data driver 150*a* and a slave data driver 150*b* as an example. This is described in detail below.

As shown in FIG. 9, the master data driver 150*a* includes a voltage monitor unit 157, a gate control signal output unit 156, a data control signal output unit 158, a data memory 155, and a data output unit 159. On the other hand, the slave data driver 150*b* does not include the voltage monitor unit 157, the gate control signal output unit 156, and the data control signal output unit 158. When the alarm signal OFS is supplied, the data control signal output unit 158 of the master data driver 150*a* controls the data output unit 159 of the master data driver 150*a* and outputs a data control signal DMS.

The master data driver 150*a* and the slave data driver 150*b* may be connected to each other through a data control signal line DMSL. The data control signal line DMSL transmits the data control signal DMS. The master data driver 150*a* and the gate driver 140 may be connected to each other through a gate control signal line GAHL. The gate control signal line GAHL transmits the gate control signal GAH.

When the input voltage Vin is out of the predetermined range, the master data driver 150*a* converts all of the data signal output from the master data driver 150*a* into the black data signal and supplies the data control signal DMS to the slave data driver 150*b*. Hence, the slave data driver 150*b* also converts all of the data signal output from the slave data driver 150*b* into the black data signal. Further, the master data driver 150*a* supplies the gate control signal GAH to the gate driver 140. Hence, the gate driver 140 converts all of the gate signal output from the gate driver 140 into the gate high voltage in response to the gate control signal GAH supplied from the master data driver 150*a*.

As described above, the display device according to the embodiments of the invention solves the screen flicker or the image sticking appearing in a portion of the display panel even if the power supply unit is repeatedly turned on and off, thereby improving the display quality and the reliability of the power supply unit.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel;

a data driver supplies a data signal to the display panel;

a gate driver supplies a gate signal to the display panel;

a power supply to supply electric power to at least one of the display panel, the data driver, and the gate driver;

a voltage monitor monitors an output voltage output from the power supply unit and output an alarm signal when the output voltage is cut off; and a timing controller receives the alarm signal, and in response:

outputs a gate control signal to simultaneously convert the gate signal output from the gate driver into a gate-on voltage for all gate lines during a power-off period; and outputs a data control signal to simultaneously convert the data signal output from the data driver into a black data signal for all data lines during the power-off period, wherein the gate-on voltage gradually decreases during the power-off period.

2. The display device of claim 1, wherein when the gate control signal reaches a low logic level, the gate driver is configured to convert the gate signal into the gate-on voltage; and when the data control signal reaches the low logic level, the data driver is configured to convert the data signal into the black data signal.

3. The display device of claim 1, further comprising:

a memory linked with the timing controller; and wherein the timing controller in response to receiving the alarm signal, reads black data from the control memory for converting the data signal into the black data signal.

4. The display device of claim 1, further comprising:

a data memory in communication with the data drive; and wherein when the data control signal is supplied, the data driver reads black data from the data memory for converting the data signal into the black data signal.

5. The display device of claim 1, wherein the timing controller supplies the data control signal to the data driver through two signal lines.

6. The display device of claim 1, where the timing controller supplies the data control signal to the data driver through one signal line.

7. The display device of claim 1, wherein the display panel comprises a liquid crystal display panel including a liquid crystal element; and where the black data signal includes a gray level or a voltage level forming an equipotential along with a common voltage supplied through a common voltage line.

8. The display device of claim 1, wherein the display panel comprises an organic light emitting display panel including an organic light emitting element; and where the black data signal has a gray level or a voltage level forming an equipotential along with a ground level voltage supplied through a ground line.

9. The display device of claim 1, where the gate driver outputs multiple gate signals; and where the timing controller outputs the gate control signal to convert the multiple gate signals output from the gate driver into the gate-on voltage.

10. The display device of claim 9, where the gate driver simultaneously converts the multiple gate signals into the gate-on voltage in response to receiving the gate control signal.

11. The display device of claim 1, where the gate driver converts all gate signals output from the gate driver into the gate-on voltage in response to receiving the gate control signal.

12. The display device of claim 1, where the gate driver simultaneously converts all gate signals output from the gate driver into the gate-on voltage in response to receiving the gate control signal.

13. The display device of claim 1, wherein the output voltage gradually decreases to a ground voltage before the gate signals for all the gate lines decrease from the gate-on voltage to a gate-low voltage.

14. The display device of claim 1, wherein the black data signal corresponds to a data voltage that gradually decreases during the power-off period.

15. A display device comprising:

a display panel;

a data driver supplies a data signal to the display panel;

a gate driver supplies a gate signal to the display panel;

a power supply supplies electric power to at least one of the display panel, the data driver, and the gate driver; and a timing controller controls the data driver and the gate driver, wherein the timing controller outputs a gate control signal indicative of a monitored input voltage, where when the input voltage is out of a predetermined range, the gate control signal, causes the gate driver to convert the gate signal output from the gate driver into a gate-on voltage simultaneously for all gate lines and causes the data driver to converts the data signal output from the data driver into a black data signal simultaneously for all data lines during a power-off period, wherein the gate-on voltage gradually decreases during the power-off period.

16. The display device of claim 15, wherein when the gate control signal reaches a low logic level, the gate driver converts the gate signal into the gate-on voltage.

17. The display device of claim 15, wherein when the input voltage is out of the predetermined range, the data driver reads black data from a data memory linked to the data driver for converting the data signal into the black data signal.

18. The display device of claim 15, wherein the data driver comprises N data drivers, where N is a positive integer equal to or greater than 2, wherein a first data driver of the N data drivers comprises a voltage monitor unit for monitoring the input voltage, wherein when the input voltage is out of the predetermined range, the voltage monitor unit outputs a data control signal so data signals output from the N data drivers are converted into the black data signal.

19. The display device of claim 15, wherein the display panel comprises a liquid crystal display panel including a liquid crystal element; and where the black data signal has a gray level or a voltage level forming an equipotential along with a common voltage supplied through a common voltage line.

20. The display device of claim 15, wherein the display panel comprises an organic light emitting display panel including an organic light emitting element; and where the black data signal has a gray level or a voltage level forming an equipotential along with a ground level voltage supplied through a ground line.

* * * * *